US010492011B1

(12) United States Patent
Haynes et al.

(10) Patent No.: US 10,492,011 B1
(45) Date of Patent: Nov. 26, 2019

(54) NON-SURGICAL BONE CONDUCTION HEARING AID

(71) Applicants: Joel E. Haynes, Tarzana, CA (US); Tolabus Stein, Los Angeles, CA (US)

(72) Inventors: Joel E. Haynes, Tarzana, CA (US); Tolabus Stein, Los Angeles, CA (US)

( * ) Notice: Subject to any disclaimer, the term of this patent is extended or adjusted under 35 U.S.C. 154(b) by 0 days.

(21) Appl. No.: 16/279,603

(22) Filed: Feb. 19, 2019

(51) Int. Cl.
*H04R 25/00* (2006.01)
*H04R 9/02* (2006.01)
*H04R 1/46* (2006.01)
*H04R 1/10* (2006.01)

(52) U.S. Cl.
CPC ..... *H04R 25/606* (2013.01); *H04R 1/46* (2013.01); *H04R 9/025* (2013.01); *H04R 1/1066* (2013.01); *H04R 25/70* (2013.01); *H04R 2225/67* (2013.01); *H04R 2460/13* (2013.01)

(58) Field of Classification Search
CPC ..... H04R 1/1066; H04R 1/46; H04R 9/025; H04R 11/02; H04R 25/606; H04R 25/70; H04R 2225/67; H04R 2460/13
USPC ..... 382/322, 324, 326, 328, 330, 380, 151; 600/25; 507/56, 57; 607/56, 57
See application file for complete search history.

(56) References Cited

U.S. PATENT DOCUMENTS

| | | | | |
|---|---|---|---|---|
| 4,612,915 | A | 9/1986 | Hough | |
| 5,447,489 | A | 9/1995 | Issaiene | |
| 5,460,593 | A * | 10/1995 | Mersky | H04R 25/606 381/190 |
| 5,624,376 | A * | 4/1997 | Ball | H04R 11/02 600/25 |
| 6,041,129 | A | 3/2000 | Adelman | |
| 6,175,596 | B1 | 8/2001 | Fretz | |
| 6,643,378 | B2 | 11/2003 | Schumaier | |
| 6,940,989 | B1 | 9/2005 | Shennib | |
| 9,998,829 | B2 * | 6/2018 | Asfaw | H04R 11/14 |
| 2007/0041595 | A1 | 2/2007 | Garazo | |
| 2009/0259090 | A1 | 10/2009 | Parker | |
| 2010/0222639 | A1 | 9/2010 | Purcell et al. | |

* cited by examiner

*Primary Examiner* — Huyen D Le
(74) *Attorney, Agent, or Firm* — Patent Law Inc; Benjamin A. Balser

(57) ABSTRACT

A non-surgical bone conductive hearing aid that provides an in-the-ear, vibration transducer that vibrates the Mastoid bone, in which the middle ear and cochlea are embedded. The bone vibration bypasses the outer and middle ear and stimulates the inner ear. The cochlear within the inner ear convert the sound to electrical impulses that travel to the brain allowing the recipient to hear naturally.

17 Claims, 4 Drawing Sheets

NON-SURGICAL BONE CONDUCTION HEARING AID

TECHNICAL FIELD

The invention generally pertains to hearing aid devices, and more particularly to bone conductive hearing aid.

BACKGROUND ART

There are basically three types of hearing loss: sensorineural hearing loss conductive bearing loss and mixed hearing loss. Sensorineural hearing loss is caused by the nerve damage in the inner ear and is the most common cause of hearing loss. This kind of hearing loss is typically caused by damage to the inner hair cells by loud noises and/or ageing. Conductive hearing loss occurs when the ear's ability to conduct sounds to the auditory nerve is impaired. This kind of hearing loss can occur in any part of the ear, although it is most common in the outer ear or the middle ear. Mixed hearing loss is a combination of conductive and sensorineural hearing loss.

Minor hearing loss can be improved with traditional "air conduction" hearing aids, but becomes less beneficial for medium hearing loss. Bone conduction hearing aids can be useful for individuals with medium to severe loss. Persons with severe to profound sensorineural hearing loss in both ears are candidates for cochlear implants. Some bone conduction hearing aids require surgery and others do not. For example, cochlear implants require a more complex surgical procedure than a bone conductive procedure.

A search of the prior art did not disclose any literature or patents that read directly on the claims of the instant invention. However, the following U.S. patents are considered related:

| PAT NO. | INVENTOR | ISSUED |
|---|---|---|
| 4,612,915 | Hough | Sep. 23, 1986 |
| 6,643,378 | Schumaier | Nov. 4, 2003 |
| 6,940,989 | Shennib | Sep. 2005 |
| 2010/0222639 | Purcell et al | Pub. Sep. 2, 2010 |

The U.S. Pat. No. 4,612,915 discloses a surgically implanted direct bone conduction hearing aid, that provides a remote electronic processor with output transmitters that make contact through the patient's skin with the implant. The processor is connected to the transmitters with wires similar to music earphone speakers. There are always risk involved with any surgical procedure and it naturally, adds cost to the hearing aids. Bone conductive hearing aids can be provided without surgery with equal results.

The U.S. Pat. No. 6,643,378 discloses a bone conduction hearing aid that does not require surgery. It is an in the ear hearing aid that provides an ultrasonic cylindrical shape transducer as the vibrator. The vibrator is encased within a hard plastic which transfers the vibrations to the mastoid bone. A more efficient material would be a heavy filled epoxy. The reason for the apparent concern for undesirable feedback is that the, all-in-one in-the-ear package provides the feedback path from the vibrator to the microphone. For that reason most designs include acoustic insulation around the microphone. As there should be only vibration and no air audio, the insulation should be to prevent vibration. The hearing aid is directed, primarily toward patients with loss in only one ear.

The U.S. Pat. No. 6,940,989 discloses a conventional hearing devices having an the canal component, the hearing device of the present invention odes not occlude the ear canal nor does it interrupt the ossicular chain. In other words, the present invention does not interfere with a recipient's remaining natural hearing nor the normal biological functioning of the ear.

The 2010/0222639 publication is a self-retaining bone conduction hearing device having a vibrating component responsive to the sound processor and configured of non-surgical-implantation in a recipient's ear canal. Utilizing bone conduction eliminates the dependency acoustic stimulation, thereby enabling the hearing device of the invention to address a wider range of sound frequencies in conductive hearing loss. Unlike conventional hearing devices having an in the-canal component, the hearing device of the present invention does not occlude the ear canal nor does it interrupt the ossicular chain. In other words, the present invention does not interfere with a recipient's remaining natural hearing or the normal biological functioning of the ear.

For background purposes and indicative of the art to which the invention relates, reference may be made to the following remaining patents found in the patent search.

| PAT NO. | INVENTOR | ISSUED |
|---|---|---|
| 5,447,489 | Issaiene | Sep. 5, 1995 |
| 6,041,129 | Adelman | Mar. 21, 2000 |
| 6,175,596 | Fretz | Aug. 14, 2001 |
| 2007/0041595 | Garazo | Feb. 22, 2007 |
| 2009/0259090 | Parker | Oct. 15, 2009 |

DISCLOSURE OF THE INVENTION

A bone conduction hearing aid that requires no surgery that provides an in the ear, vibration transducer probe, molded to fit the recipient's outer ear canal that vibrates the Mastoid bone at audio frequencies, to which the middle ear and cochlea are embedded. The bone vibration bypasses the outer and middle ear and stimulates the inner ear. The cochlear inside the inner ear converts the vibration to electrical impulses that ravel to the brain allowing the recipient to hear naturally.

In view of the above disclosure, the primary object of the invention is to produce a surgical bone conduction hearing aid that provides increased hearing capability compared to other conventional hearing aids or devices.

In addition to the primary object of the invention it is also an object of the invention to provide a non-surgical bone conduction hearing aid that:

- is comfortable to wear,
- requires no maintenance,
- is easy to clean,
- has an extended useful life,
- is cost effected from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
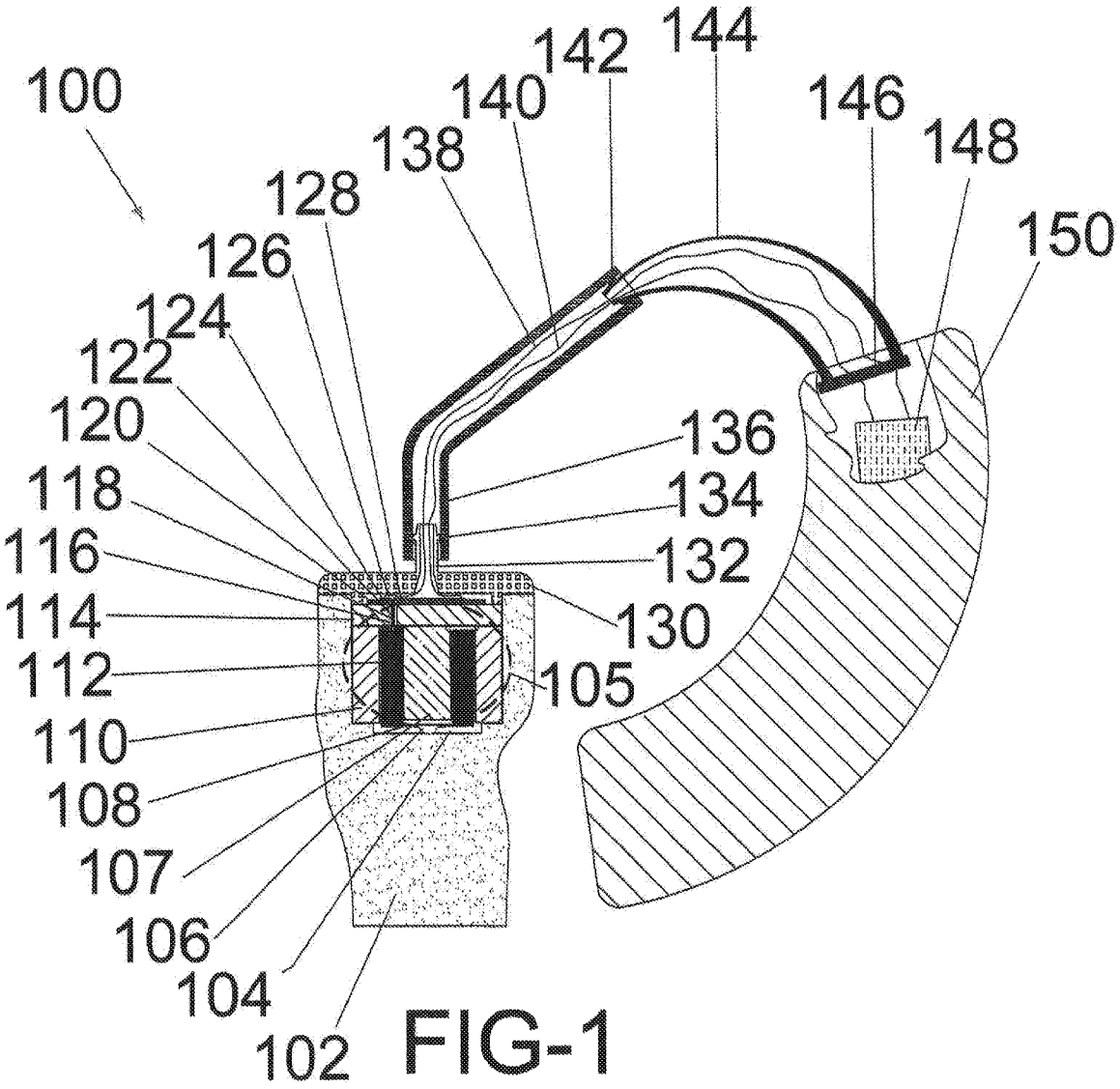
FIG. 1 is a sectional view drawing of a preferred embodiment of the present invention.
Figure 3:
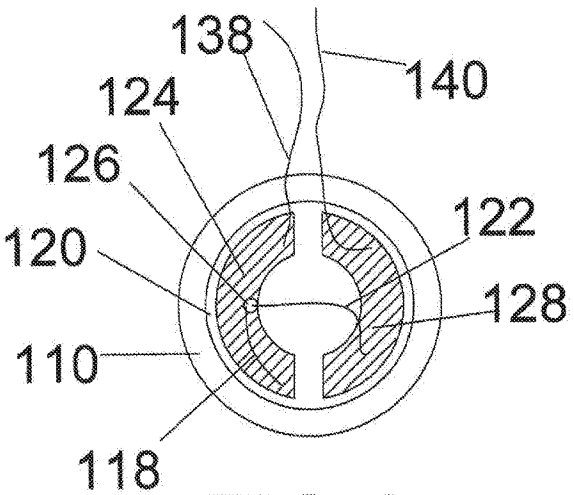
FIG. 3 is a top end view drawing of the moving coil vibration transducer of a preferred embodiment of the present invention.
Figure 2:
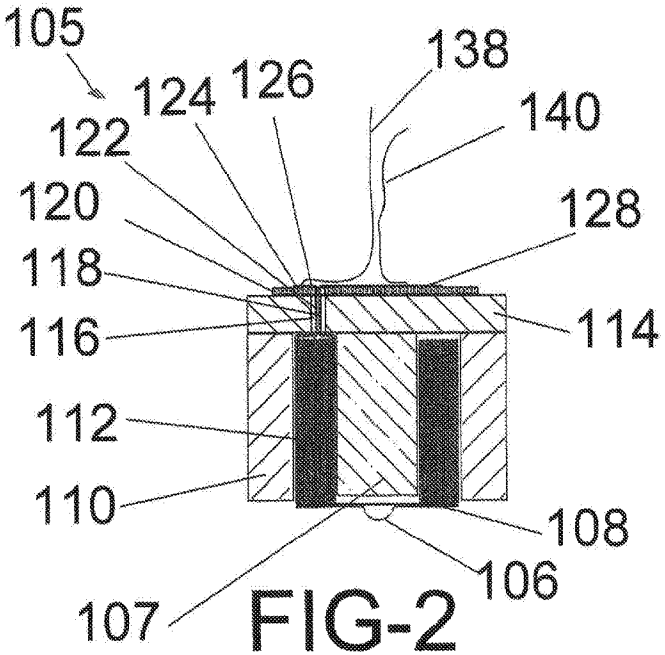
FIG. 2 is a sectional view drawing of a moving coil vibration transducer of a preferred embodiment of the present invention.
Figure 4:
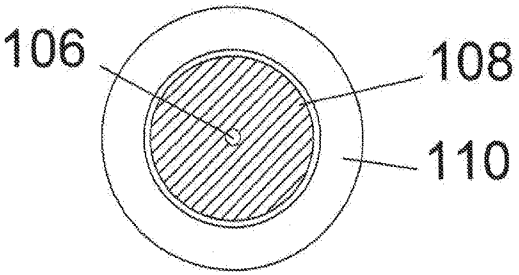
FIG. 4 is a lower end view drawing of the moving coil vibration transducer of a preferred embodiment of the present invention.

The best mode for carrying out the invention is presented in terms that disclose a preferred embodiment of a non-surgical bone conductive hearing aid 100 and 200. As shown in FIG. 1, the hearing aid 100 is comprised of the following major elements: probe 102,202, moving or stationary coil 105,212, neodymium magnet 107, ferrous metal cap 114, printed circuit board (PCB) 120,220, and moving coil or stationary coil vibrator 200,205.

Referring to FIGS. 1-9, is a bone conduction in the ear hearing aid 100, in accordance with the invention. The insertion, solid probe 102 is custom formed to fit the patient's outer ear canal. The probe 102 is preferably constructed with heavy filled epoxy. The solid construction of probe 102 prevents background noise, feedback, and transfer sound vibration efficiently. The probe 102 is constructed with a cavity 104 that provides space for inserting a moving coil vibrator 105, which includes a non-ferrous disk 108 with a riser 106 that makes contact and transfers vibrations from the moving coil 112 into the probe 102. The vibrator 105 is held securely in position by a cover 130 which is preferably constructed with a low sound speed material made of polyethylene that reduces extraneous background noise. The cover 130 is also preferably constructed with a fitting connector 132 that includes a raised diameter barb 134 which provides ease of connection of a plastic tube 136 and holds the tube 136 firmly connected to the connector 132. The moving coil 112 is constructed with insulated coil wire with wire ends 118 and 122 that are routed through a thru-hole 116 on the ferrous cap 114 and a thru-hole 126 of a printed circuit board (PCB) 120. The wire end 118 is attached to first solder pad 124 and the wire end 122 is attached to the PCB 120 at a second solder pad 128.

A first insulated wire 138 is connected to the PCB 120 at the first solder pad 124, and a second insulated wire 140 is connected to the PCB 120 at the second solder pad 128. The insulated wire 138 and wire 140 are routed through the tube 136, and a horn-shaped fitting tube 144 that is held by a tube fitting 142 within the tube 136. The horn shaped tube 144 is attached to a processor 150 at a connection 146, and interfaces with electrical components 148 within the processor 150, as shown in FIG. 1.

Referring to FIG. 1, FIG. 2, FIG. 3 and FIG. 4, the vibrator 105 is constructed with the permanent neodymium magnet 107 that is centrally positioned inside a ferrous metal tube 110. A ferrous metal round cap 114 with equal diameter to the tube 110 is positioned to contact the tube 110 and magnet 107 so as to provide a flux path around the moving coil 112. The coil 112 is positioned so as to freely move between the inner wall of the tube 110 and the outer wall of magnet 107. The coil 112 in response to the audio input of the processor 150 causes the flux field and vibration changes of the non-ferrous disk 108, point contact 106 and probe 102.

Figure 5:
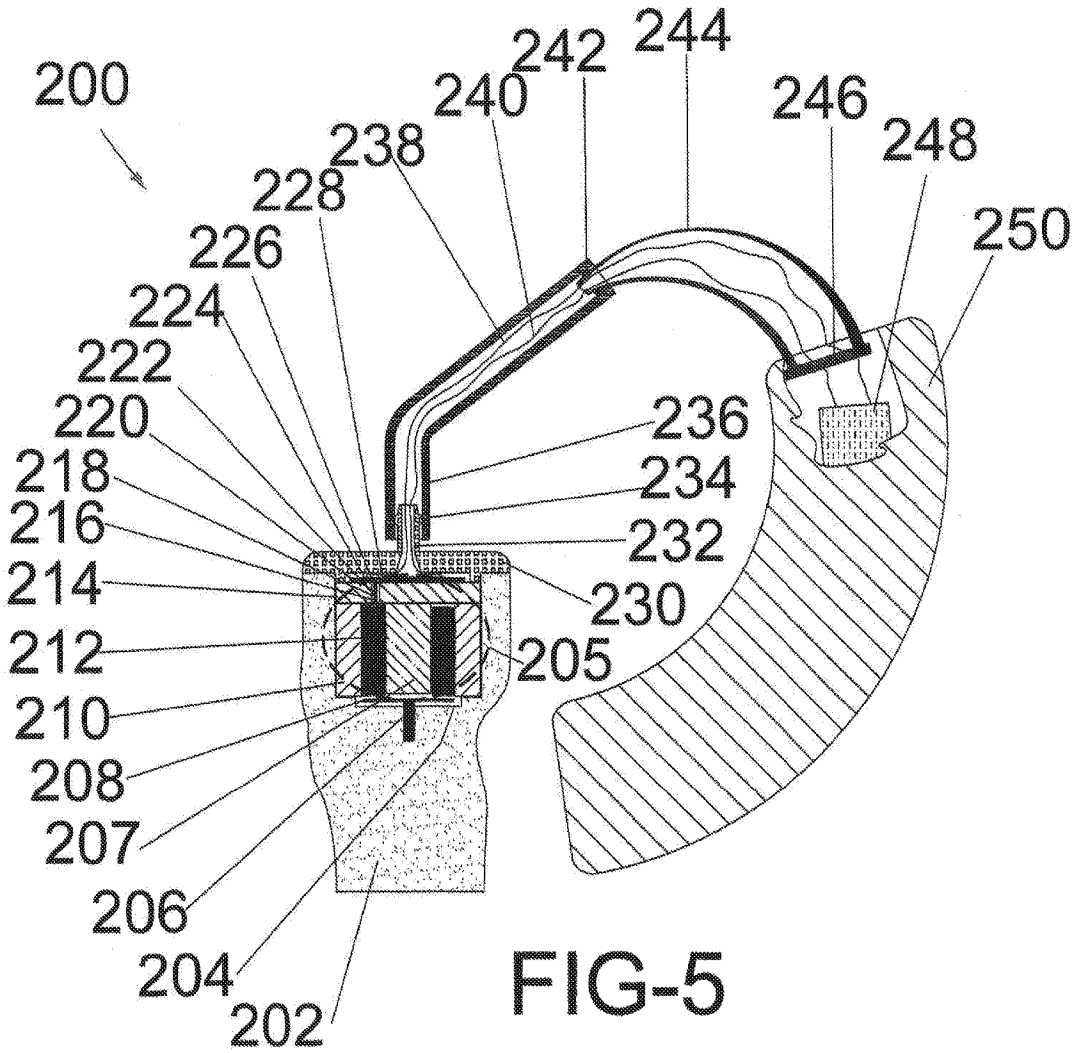
FIG. 5 is a sectional view drawing of an alternative embodiment of the present invention with a stationary coil vibration transducer.
Figure 7:
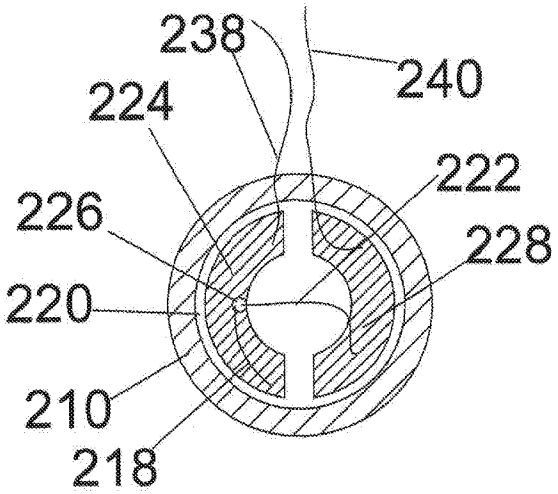
FIG. 7 is a top end view drawing of the stationary coil vibration transducer of an alternative embodiment of the present invention
Figure 9:
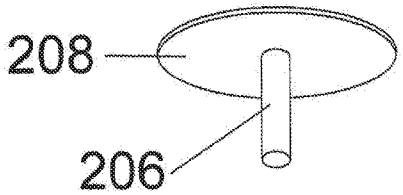
FIG. 9 is a perspective view drawing of the ferrous metal vibration driving disk of the alternative embodiment of the present invention.
Figure 6:
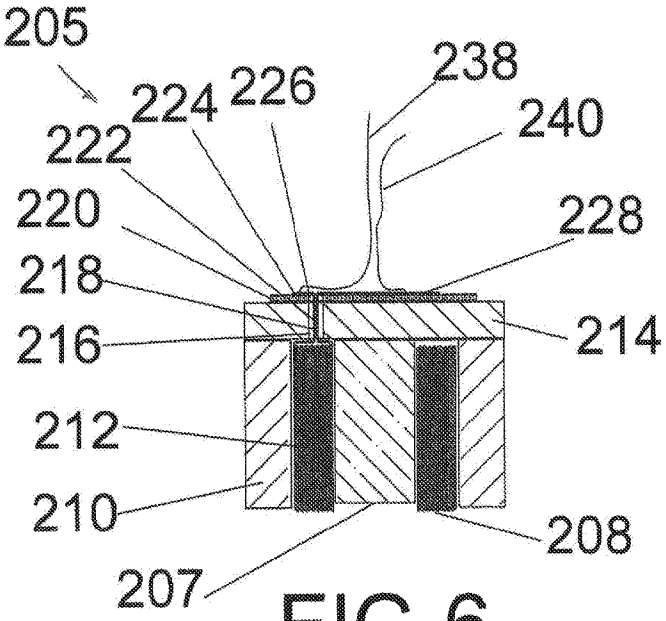
FIG. 6 is a sectional view drawing of a stationary coil vibration transducer of an alternative embodiment of the present invention.
Figure 8:
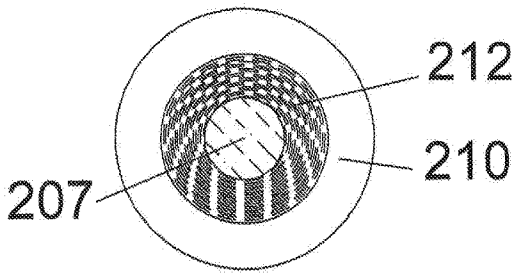
FIG. 8 is a lower end view drawing of the stationary coil vibration transducer of an alternative embodiment of the present invention.

FIG. 5 is an alternate illustration of the invention that replaces the vibrator 105 with a stationary of vibrator 205. The insertion solid probe 202 is custom formed to fit a person's outer ear canal. The probe 202 is preferably constructed with heavy-filled epoxy. The solid construction of the probe 202 reduces background noise and feedback, and transfers sound vibration efficiently. The probe 202 is constructed with a cavity 204 that provides space for inserting the stationary coil vibrator 205.

The probe 202 includes a ferrous disk 208 that includes a connecting rod 206 that is molded into the probe 202. The disk 208 vibrates in response to flux changes produced by the vibrator 205 and transfers the vibrations to a rod 206 and the probe 202.

The vibrator 205 is held securely in position by the cover 230. The cover 230 is preferably constructed with a low sound speed material made of polyethylene that reduces extraneous background noise. The cover 230 is also preferably constructed with a tube fitting connector 232 that includes a raised diameter barb 234 that provides ease of connection of a tube 236 and holds the tube 236 firmly connected to the connector 232. The stationary coil 212 is constructed with insulated coil wire with the wire ends 218 and 222 routed through the thru-hole 216 of the ferrous cap 214 and thru-hole 226 of the PCB 220. The first wire end 218 is attached to a first solder pad 224 and the second wire end 222 is attached to the PCB 220 at the second solder pad 228.

A first insulated wire 238 is connected to the PCB 220 at the first solder pad 224 and a second insulated wire 240 is connected to the PCB 220 at a second solder pad 228. The insulated wire 238 and wire 240 are routed through a tube 236, a horn-shaped tube 244, that is held by a tube fitting 242 within the tube 236, terminate at a processor 250, is held in place by a connection 246, and interfaces with the electrical components 248 within the processor 250, as shown in FIG. 5.

Referring to FIG. 5, FIG. 6, FIG. 7, FIG. 8 and FIG. 9, the vibrator 205 is constructed with a permanent magnet 207 that is centrally positioned inside a ferrous metal pipe 210. A ferrous metal round disk 214 with a diameter equal to the pipe 210 is positioned to contact the pipe 210 and neodymium magnet 207 so as to provide a flux path around a stationary coil 212. The coil 212 is positioned between the inner wall of the pipe 210 and the outer wall of the magnet 207. The coil 112 in response to the audio input of the processor 250 causes a flux field and vibration changes of the ferrous disk 208, rod 26 and probe 202.

There have been many advances of hearing aid technology during the last decade. However, the processes in the cochlea that result in the perception of sound are to date still debated. The major theories are described in sections "Compression", "Inertia", "Third-Window theory", "Dynamic Pressure Transmission" and Pathological Third Window of the Inner Ear".

Damaged hair cells, within the cochlear do not naturally recover or grow new ones. However, a group of scientists from MIT Medical have formed a company, "Frequency Therapeutics" and discovered a method that regrows hair cells within the inner ear, although they say it will be years before the technology will be available to the public.

Tatjana Tchurnatchenko from the Max Planck Institute of Brain Research in Frankfurt and Tobias Reichenbach from Imperial College London, explained how bone conduction works with the help of fluid dynamic calculations. Their model provides new insights into previously unknown processes. A cochlear-bone wave can yield a hearing sensation as well as optoacoustic emission.

Lab-testing of the present invention with human patients with profound sensorineural hearing loss, in both ears, have led to one or a combination of both of the following conclusions:

- the bone conduction vibrations force the damaged hair cells to vibrate thereby producing sound waves within the auditory nerve, and
- a portion of the bone conduction vibrations are bypassing the hair cells and causing the auditory nerve to produce the sound waves.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A non-surgical bone conduction hearing aid comprising:

- a probe configured to fit within a person's outer ear canal, and having a cavity,
- a vibrator configured within the probe cavity and having a magnet that is centrally positioned and surrounded by a metal pipe,
- a metal cap positioned on top of the pipe and magnet,
- a moving coil positioned centrally between the magnet and the pipe,
- a disk attached to a lower end of the coil,
- a round riser positioned centrally on the disk and contacting the probe via a single tangent point,
- a printed circuit board (PCB) positioned centrally on and attached to the cap, and configured with a first and second solder pad,
- a cover plate attached to the top of the probe,
- a tube that is attached to the cover plate via a connector barb,
- a horn-shaped fitting configured to conform to a person's ear with a first end and a second end, with the first end attached to the tube,
- a processor assembly enclosing electronic components and configured to fit behind a person's ear, the assembly attached to the second end of the horn-shaped fitting,
- a first routing wire originating at the PCB first solder pad and extending through the tube, the horn-shaped fitting and terminating at the electronic components within the processor, and
- a second routing wire originating at the PCB second solder pad and extending through the rube, the horn-shaped fitting and terminating at the electronic components within the processor.

2. The bone conduction hearing aid of claim 1, wherein the probe is solid.

3. The bone conduction hearing aid of claim 1, wherein the probe is made of epoxy.

4. The bone conduction hearing aid of claim 1, wherein the cover is made of a low sound speed material.

5. The bone conduction hearing aid of claim 4, wherein the low sound of speed material is polyethylene.

6. The bone conduction hearing aid of claim 1, wherein the vibrator is comprised of a moving coil vibrator.

7. The bone conduction hearing aid of claim 1, wherein the magnet is comprised of a neodymium magnet.

8. The bone conduction hearing aid of claim 1, wherein the tube is made of plastic.

9. A non-surgical bone conduction hearing aid comprising:

- a probe configured to fit within a person's outer ear canal and having a cavity,
- a stationary coil vibrator configured within the probe cavity,
- a ferrous disk having a connecting rod molded into the probe,
- a cover plate that is attached to the probe,
- a tube that is attached to the cover plate via a connector barb,
  - a magnet configured within the vibrator,
  - a ferrous metal enclosure pipe configured to surround the coil,
- a ferrous cap configured to contact the enclosure pipe and magnet,
- a printed circuit board (PCB) positioned centrally on and attached to the cap and configured with a first and a second solder pad,
- a horn-shaped fitting configured to conform to a person's ear with a first end and a second end, with the first end attached to the tube,
- a processor assembly enclosing electronic components and configured to fit behind a person ear, the assembly attached to the second end of the horn-shaped fitting,
- a first routing wire originating at the PCB first solder pad and extending through the tube, the horn-shaped fitting and terminating at the electronic components within the processor, and
- a second routing wire originating at the PCB second solder pad and extending through the tube, the horn-shaped fitting and terminating at the electronic components within the processor assembly.

10. The bone conduction hearing aid of claim 9, wherein the probe is solid.

11. The bone conduction hearing aid of claim 9, wherein the probe is made of epoxy.

12. The bone conduction hearing aid of claim 9, wherein the cover is made of a low sound speed material.

13. The bone conduction hearing aid of claim 12, wherein the low sound speed material is polyethylene.

14. The bone conduction hearing aid of claim 9, wherein the magnet is comprised of a neodymium magnet.

15. The bone conduction hearing aid of claim 9, wherein the tube is made of plastic.

16. The bone conduction hearing aid of claim 9, wherein the magnet provides a continuous field in which the coil causes the ferrous disk to vibrate in response to electrical audio input.

17. The bone conduction hearing aid of claim 9, wherein the ferrous disk vibrates in response to flux changes generated by the coil, and transfers the vibrations through the rod to the probe.

* * * * *